United States Patent [19]

Wright et al.

[11] Patent Number: 4,930,179

[45] Date of Patent: Jun. 5, 1990

[54] DECORATING TOOL

[75] Inventors: Paul B. Wright, Lower Earley; Mary V. Ward, London, both of England

[73] Assignee: Imperial Chemeical Industries, plc, London, England

[21] Appl. No.: 228,277

[22] Filed: Aug. 4, 1988

[30] Foreign Application Priority Data

Aug. 5, 1987 [GB] United Kingdom ..... 8718532
Apr. 19, 1988 [GB] United Kingdom ..... 8809173

[51] Int. Cl.[5] ..... B05C 17/02

[52] U.S. Cl. ..... 15/230.11; 15/230.16; 15/235; 29/110.5; 29/121.1; 29/132

[58] Field of Search ..... 15/230.11, 210.5, 230.16, 15/230, 230.14, 230.19; 29/110.5, 120, 121.1, 121.5, 130–132

[56] References Cited

U.S. PATENT DOCUMENTS

| | | | |
|---|---|---|---|
| 1,003,647 | 9/1911 | Piper | 15/230.16 |
| 1,685,406 | 9/1928 | Kimman | 29/121.5 |
| 3,536,037 | 10/1970 | Mortellito | 15/230.11 |
| 3,669,069 | 6/1972 | Bourboulis . | |
| 4,201,801 | 5/1980 | Hori . | |
| 4,293,599 | 10/1981 | Hori et al. . | |

FOREIGN PATENT DOCUMENTS

| | | | |
|---|---|---|---|
| 233923 | 7/1910 | Fed. Rep. of Germany . | |
| 1690640 | 1/1955 | Fed. Rep. of Germany . | |
| 2548273 | 10/1975 | Fed. Rep. of Germany . | |
| 8601648 | 6/1986 | Fed. Rep. of Germany . | |
| 553522 | 7/1942 | United Kingdom . | |
| 604630 | 10/1946 | United Kingdom . | |
| 1022438 | 3/1966 | United Kingdom | 15/230.16 |

*Primary Examiner*—Edward L. Roberts
*Attorney, Agent, or Firm*—Cushman, Darby & Cushman

[57] ABSTRACT

A decorating tool (1) suitable for creating a broken pattern in e.g. flowable paint, varnish or glazes to simulate for example ragging, sponging and rag-rolling effects. The tool (1) comprises flexible flaps (6*a* and 6*b*) attached to a roller (2) so that when the roller (2) is rolled across a coat of paint etc, the flaps (6*a*, 6*b*) strike the paint and create the broken pattern. The tool may be used to distress the coating whereupon flaps (6*a*, *b* 6*b*) are preferably made from sheepskin or chamois leather. Also a method for creating a broken pattern by use of the roller (2), especially use of the roller to create a broken pattern in a paint, varnish or glaze containing an additive to retard drying.

15 Claims, 2 Drawing Sheets

DECORATING TOOL

BACKGROUND OF THE INVENTION

This invention relates to a (preferably hand-holdable) decorating tool suitable for providing a flowable surface-coating having a broken pattern. The broken pattern is sometimes called a "distressed" pattern. Typical fluid surface-coatings comprise wet paint (including so-called solid emulsion paint which can be made to flow under shear) varnish or painters' glaze. This document also discloses to a method for providing a flowable surface-coating having a broken pattern obtained by use of the tool.

Broken pattern surface-coatings were very popular in the 1930's. They were produced by such techniques as "ragging on" and "sponging" in which a rag or sponge was used to apply paint to produce the broken pattern or "ragging off" or "rag-rolling" where a wet coat of paint was applied to a surface and then the broken pattern was imparted by disturbing the paint by dabbing it with a rag or rolling a rolled up rag or piece of leather over the painted surface while the paint was still wet. Fuller descriptions of these techniques are provided in the books "Paint Magic" by Jocasta Innes and published in London by Frances Lincoln Publishers Limited in 1981 (see pages 42 to 45, the contents of which are herein incorporated by reference) and "The Complete Book of Decorating Techniques" by Linda Gray and Jocasta Innes and published by Orbis of London in 1986 (see pages 106 to 109, 116 to 119 and 176 and 177, the contents of which are herein incorporated by reference). These techniques require considerable skill to produce a pleasing effect and to enable the decorating operation to be completed before surface-coating dries and loses its flowability. Few non-specialist painters possess the necessary skill and so the techniques have been increasingly expensive to apply.

SUMMARY OF THE INVENTION

One of the objects of this invention is to provide a tool for producing a broken patterned surface-coating which tool is quick and easy to use even by non-specialist painters. An object of various refinements of this invention is to produce a tool which simulates the broken pattern produced by rag-rolling.

Accordingly this invention provides a (preferably hand-holdable) decorating tool suitable for use in providing a flowable surface-coating having a broken pattern and applied to a surface which tool comprises a roller, a plurality of flexible flaps, each flap extending in a direction inclined at an angle of from 0° to 50° to the axis of the roller and each flap having a proximal and a distal end and means which attach the proximal end of each flap to the roller. Typical surfaces to which the fluid surface-coating may be applied include the surfaces of walls, ceilings, room trims and fittings (for example doors, skirting boards, radiators) and furniture especially furniture having large surface-areas such as wardrobes. The decorating tool may be dipped into the fluid surface coating and then rolled across the surface to apply a broken patterned surface-coating or more preferably it may be rolled across a fluid surface-coating already applied to the surface whereupon the passage of the roller disturbs the surface-coating to produce a broken pattern. Use of the tool requires minimal skill to produce a pleasing effect quickly. The tool may be rolled across the surface in a series of parallel paths but less repetitive effects and less skill is required if the tool is rolled in a series of randomly inclined directions.

It is important that the flaps should strike the surface with sufficient force to distrube the surface coating and so the proximal ends of the flaps should be attached to the roller along a line which extends generally axially of the roller and is inclined by not more than 50° to the axis of the roller. This line of attachment may be straight or curved and the curves may be sharp enough to induce radial folds in the flap. Alternatively, some materials such as chamois leather may develop radial and/or longitudinal folds without inducement by the line or attachment. Folds increase the randomness of the broken pattern. The randomness may also be increased if the line of attachment of the proximal ends of the flaps is inclined at an angle of at least 0.1 and preferably 1° to 20° to the axis of the roller. When a more random pattern is obtained, less care is needed in joining the patterns created by adjacent passes of the tool.

The lines of attachment of adjacent flaps should preferably be spaced circumferentially such that they are far enough apart to avoid one flap interfering with the freedom of the other flaps to strike the coating yet close enough together to ensure that the surface of the roller does not unduly contact the coating. The optimum spacing will depend on the lengths of the flaps and the radius of the rollers, but generally circumferential the circumferential spacing between the lines of attachment of adjacent flaps should be from 20 to 50 mm.

The distal end of a flap may be straight, jagged or wavy. Jagged or wavy ends increase the randomness of the pattern. Preferably the maximum radial length of a flap (that is to say the maximum distance between the distal and proximal ends of the flap when measured radially of the roller) should be short enough to prevent the flap from wrapping itself completely round the roller, but long enough to strike the surface-coating with sufficient momentum to disturb the coating. The optimum radial length for a flap will depend on the weight of the material from which the flap is made, the radius of the roller and the speed with which the tool is likely to be passed over the surface coating. In general it is preferred that at least some of the flaps should have at least one radial length of from 0.1 to 3 times the radius of the roller. For example flaps preferably have radial lengths of from 10 to 100 mm.

The axial length of a flap is preferably at least 50% of the axial length of the roller. It has been found that in some circumstances, the flaps may generate a very repetitive edge pattern which creates a tram line effect. The tram line effect if reduced or avoided if the axial extremities of each flap are cut back to form a chamfer so that the distal axial length of a flap is shorter than the proximal axial length usually by 5 to 30 mm.

The means which attach the proximal ends of the flaps to the roller may comprise for example a circumferential surface secured to the roller and stitches or pins which engage the surface. The surface may be integral with the roller or it may be provided by a sleeve which makes a tight fit around the roller. Preferably the sleeve should be firmly anchored to the roller so that is does not shift axially during use. A suitable sleeve may be elasticated so that it is easily radially outwardly stretchable enabling the sleeve to be fitted around the roller by stretching the sleeve outwardly, inserting the roller into the stretched sleeve and then releasing the stretching force so that the sleeve becomes secrued to the roller by the tension in its elastic components. If necessary, the securing action of the elastic components may be supplemented by other means such as draw-strings or pins.

The roller is preferably similar to those conventionally used in the roller painting of walls or ceilings, that is to say it is preferably about 100 to 300 mm (axially) long, has a radius of about 15 to 50 mm and is free to rotate about a central support such as an axle or a pair of pivots located on the axis of the roller. However it is also possible to use the shorter rollers of axial length 20 to 100 mm which are designed for painting trim or restricted areas. The rollers may for example have a continuous cylindrical surface or they may be composed of a plurality of parallel wires disposed to define a cylindrical barrel-like structure.

The tool flaps may be made from permeable and especially resilient materials of the type used in conventional rag-rolling. Typical permeable materials include rags, leather or leather-like materials. A review of leather-like materials is given in the third edition of the "Kirk-Othmer Encyclopaedia of Chemical Technology" Volume 14 published in 1981 by John Wiley and Sons of New York, see pages 231 to 249 (the contents of which are herein incorporated by reference). The preferred material should be premeable and is preferably a loose-textured leather (such as chamois leather or sheepskin leather) or a rag or leather-like material having properties similar to those of a loose-textured leather especially a synthetic chamois leather. For example the preferred material preferably has a weight per square meter of from 50 to 1500 g/m$^2$ (especially 150 to 600 g/m$^2$) so that when the tool is rolled across the fluid surface-coating at speeds normally used in roller painting, its flaps strike the coating with sufficient momentum to disturb the coating to a pleasing extent. For simulating rag-rolling the preferred materials are quickly penetrable by liquid and are permeable to an extent that when fully soaked with water they weigh from 50 to 3000 g/m$^2$. The most useful leathers or leather-like materials will weigh from 400 to 2000 g/m$^2$ when fully soaked. Useful materials may also be spongy, that is to say they have the ability to exude liquid quickly when compressed, for example when they strike a portion of surface not covered by flowable surface coating. It is preferred that the material be soft and supple and for this reason it is preferred that a leather be oil-tanned. Textile flaps (for example hessian, cotton or linen scrims or synthetic cloths) should be largely free from lint and should resist fraying at least along the distal end of the flap.

In a refinement of this invention, the tool comprises twin flaps composed of a single piece of material folded along a line which runs between two opposed edges of the piece of material and which is attached to the roller along the fold. Preferably the fold is nearer to one of the opposed edges than to the other so that one of the twin flaps is radially shorter than the other. The radial length of the shorter flap is preferably not more than 75% (most preferably 5 to 30%) of the length of the longer flap. Twin flaps made from an oil-tanned loose-textured leather lead to a good simulation of rag-rolling.

This document also discloses a method for creating a flowable surface-coating having a broken pattern which method comprises bringing a decorating tool comprising a roller and attached flaps according to this invention into contact with flowable surface-coating material and a surface and rolling the tool across the surface so that its flaps strike the surface one after another thereby creating a surface-coating having a broken pattern. For example the decorating tool may be brought into contact with the flowable surface-coating material by dipping the tool into a supply of the material so as to load material onto the tool and then the loaded tool is brought into contact with the surface by transferring the loaded tool to the surface. The loaded tool is then rolled across the surface whereupon it both applies a flowable surface-coating to the surface and also creates the broken pattern in the applied coating.

The simulation of ragging off and rag rolling effects are best achieved by first applying a flowable surface-coating to a surface using conventional means such as a brush, spray or ordinary paint roller and then rolling a tool according to this invention across the coating whilst it is still flowable so as to disturb the coating thereby creating a broken pattern.

Accordingly this document further discloses a method for creating a broken pattern in a flowable surface-coating applied to a surface wherein the method comprises rolling a tool comprising a roller and attached flaps according to this invention across the surface-coating whilst it is still flowable so that the flaps strike the coating and re-distribute the coating about the surface thereby creating the broken pattern. Preferably the method comprises applying to the surface a first flowable surface coating, then allowing or causing the first coating to become non-flowable (for example by drying and/or crosslinking) and subsequently applying to the surface a second flowable surface-coating and then subjecting the second flowable coating to a method according to this invention. Usually the coating which is to have the broken pattern will present a different visual effect to that of the first coating. For example the broken patterned coating will have a different colour, sheen, tone, lustre and/or texture.

Often the method will be performed using a flowable surface coating which contains an additive which retards the loss of flowability of the coating so allowing a longer period of time in which to complete the method. Where the coating loses flowability by drying, the additive will be a substace which decreases the volatility of the liquid phase of the coating. For example, a strongly polar organic compound such as a glycol may be used as the retarding additive in an aqueous coating composition. A conventional organic solvent-borne paint which loses flowability by loss of organic solvent may be diluted with a solvent having a high boiling point, for example a boiling point of over 230° C. Alternatively such paints may comprise slow drying oils of the type used in conventional oil glazes. Accordingly there is also provided for use in a method according to this invention a flowable surface coating material containing an additive for the purpose of retarding the loss of flowability when the surface coating is applied to a surface wherein the flowable surface coating material is supplied in a closed container.

BRIEF DESCRIPTION OF THE DRAWINGS

Preferred embodiments of the invention will now be described with reference to the drawings of which.

DETAILED DESCRIPTION

Figure 1:
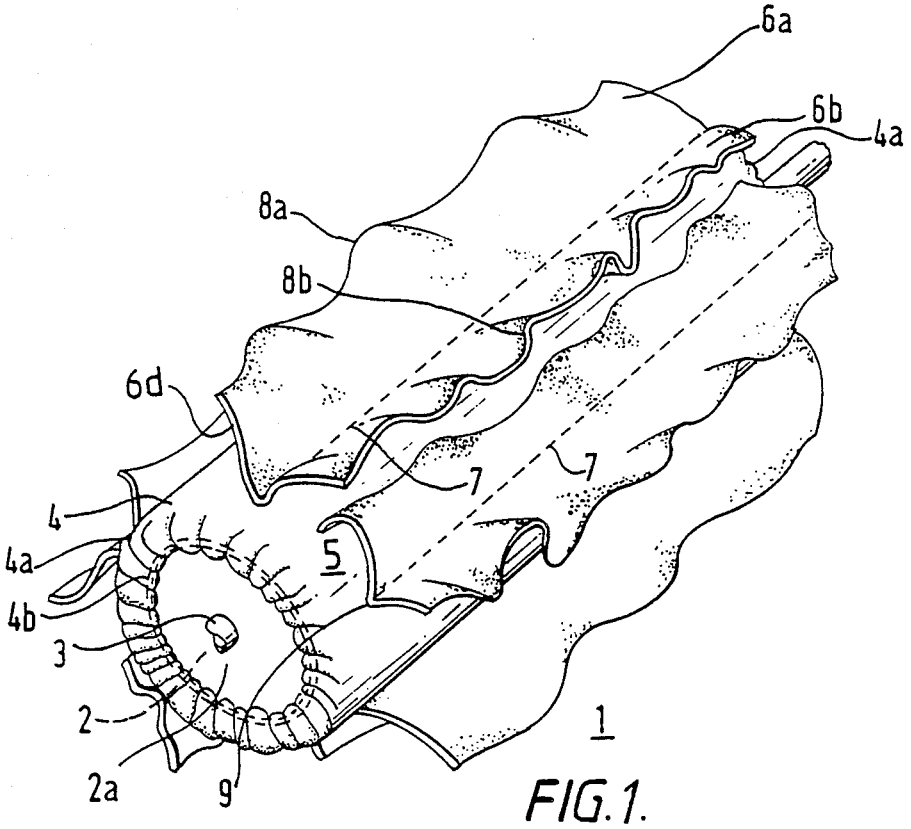
FIG. 1 is a perspective view of a tool according to this invention, shown when the tool is rotating.

FIG. 1 shows a decorating tool 1 comprising a roller 2 (not visible in FIG. 1 but shown in FIG. 2) provided with end plates 2*a* which are rotatably mounted on an axle 3. A tight-fitting elasticated sleeve 4 is fitted over roller 2. Sleeve 4 has ends 4*a* which incorporate strong elastic bands 4*b* (shown in dotted lines). Bands 4*b* cause ends 4*a* to overhang and gather around roller 2 so preventing sleeve 4 shifting along roller 2 in an axial direction. Sleeve 4 provides a circumferential surface 5 to which twin resilient flaps 6*a* and 6*b* of chamois leather are attached by lines of stitches 7 which engage surface 5. Twin flaps 6*a* and 6*b* have distal ends 8*a* and 8*b* and a common proximal end 9 provided by a fold in the chamois leather. The radial length of flap 6*a* is greater than the radial length of flap 6*b* as can be seen more clearly in FIG. 2. The axial extremities 6*c* (shown in FIG. 3) of flap 6*a* or 6*b* are cut back to form chamfers 6*d*. The lines of stitches 7 of the twin flaps are spaced equally around the circumference of sleeve 4. The lines off stitches 7 are inclined at an angle of about 5° to the axis of roller 2.

Figure 4:
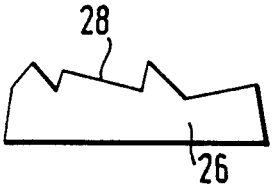
FIGS 4 and 5 are side elevations of alternative flaps.
Figure 5:
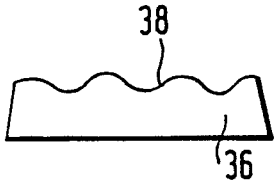

FIG. 4 shows a flap 26 which has a jagged distal end 28 and FIG. 5 shows a flap 36 which has a wavy distal end 38.

The invention is further illustrated by the following examples.

EXAMPLE 1

A sealed plaster board surface was painted with a beige mid-sheen paint and the coating of paint was allowed to dry. The painted surface was then re-painted with a paint having the following formulation:

5 parts by weight of "Dulux" Stainwood (colour: "Satin Breeze")
1 part by weight of "Keeps" scumble glaze and
1 part by weight of white spirit.

Figure 2:
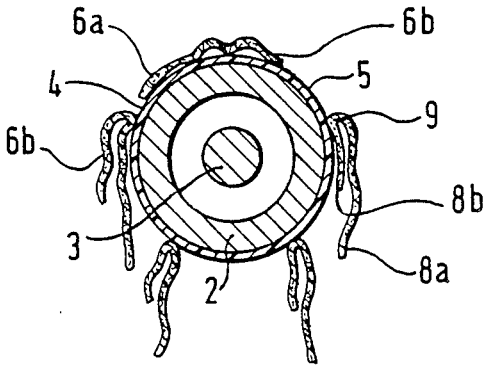
FIG. 2 is a transverse section of a tool similar to that shown in FIG. 1, but shown when the tool is stationary.
Figure 3:
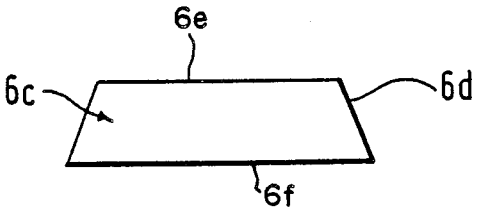
FIG. 3 is a side elevation of a flap suitable for use in the embodiment shown in FIG. 1.

Whilst the "Satinwood-based" paint was still fluid, it was disturbed (as described below) using a tool similar to that described with reference to FIGS. 1 and 2 of the drawings. The roller had a radius of 24.5 mm and an axial length of 178 mm. It was provided with twin flaps the longer of which had a radial lengths of from 25 to 40 mm and the shorter had radial lengths of from 5 to 15 mm. The circumferential distance between adjacent twin flaps was about 30 mm. The flaps had an axial length of about 150 mm and were made from chamois leather having a weight of about 440 g/m$^2$ and a permeability when fully soaked of between 480 to 1680 g of water per m$^2$ of leather. To distress the coating, the tool was first wetted with water and white spirit, then "worked in" using the "Satinwood" - based paint, then brought into contact with the plaster board and finally rolled across the painted surface in a series of randomly inclined paths with its flaps striking the plaster board one after another. The distressed paint dried to produce an effect very similar to that obtainable by rag-rolling.

EXAMPLE 2

This example illustrates the use of the invention with an aqueous paint.

A sealed plaster board surface 1 m long by 1.5 m wide was painted with an aqueous paint having the following formulation:

| | |
|---|---|
| 25 wt % | of a latex comprising a conventional methyl methacrylate/methacrylic acid/butyl acrylate copolymer of the type used in paints and an equal amount by weight of water. |
| 20 wt % | of solids other than titanium dioxide |
| 2 wt % | of titanium dioxide |
| 28 wt % | of water in addition to that provided by the latex |
| 25 wt % | of a drying retardant which was propylene glycol. |

A roller of the type used in Example 1 was wetted with water and then with paint and whilst the paint on the board and roller was still wet, the roller was rolled back and fourth across the whole surface of the plaster board. An effect very similar to that obtained by conventional rag-rolling was produced in less than 2 minutes. Even after 10 minutes under the ambient conditions, the paint was still sufficiently flowable to permit the rag-rolling effect to be produced.

We claim:

1. A decorating tool suitable for use in providing a flowable surface-coating having a broken pattern and applied to a surface, which tool comprises:
   a roller,
   a plurality of flexible, water-permeable flaps, the flaps extending in a direction inclined at an angle of from 0° to 50° to the axis of the roller and each flap having a proximal end and a distal end, and
   means which attach the proximal end of each flap to the roller.

2. A tool according to claim 1 wherein the flaps extend in a direction inclined at an angle of from 1° to 10° to the axis of the roller.

3. A tool according to claim 1 wherein the tool is provided with twin flaps, each pair of twin flaps comprising a folded material attached to the roller at the fold.

4. A decorating tool according to claim 3 wherein the radial length of one flap of each pair of twin flaps is shorter than the radial length of the other flap of the pair.

5. A tool according to claims 1 wherein the flaps (6*a*, 6*b*) comprise a material having a weight per square meter of from 50 to 1500 g.

6. A tool according to claim 1 wherein the flaps are spaced circumferentially such that the circumferential distance between a pair of adjacent flaps is from 20 to 50 mm.

7. A decorating tool according to claim 1 wherein the flaps extend in a direction inclined at an angle of from 5° to 50° to the axis of the roller.

8. A decorating tool according to claim 1 wherein the axial length of the flaps is at least 50% of the axial length of the roller.

9. A decorating tool according to claim 8 wherein the flaps are spaced circumferentially such that the circumferential distance between a pair of adjacent flaps is from 20 to 50 mm.

10. A decorating tool according to claim 1 wherein the flaps are permeable to an extend that when fully soaked with water they weigh from 50 to 3000 g/m$^2$.

11. A decorating tool suitable for use in providing a flowable surface-coating having a broken pattern and applied to a surface, which tool comprises:
   a roller, a plurality of flexible flaps, the flaps extending in a direction inclined at an angle of from 0° to 50° to the axis of the roller, the flaps comprising a real or synthetic loose-textured leather and each flap having a proximal end and a distal end, and means which attach the proximal end of each flap to the roller.

12. A tool according to claim 11 wherein the leather is either a sheepskin or a real or synthetic chamois leather.

13. A decorating tool according to claim 11 wherein the real or synthetic leather is water-permeable to the extent that when fully soaked with water it weighs from 400 to 2000 g/m$^2$.

14. A decorating tool according to claim 11 wherein the extremities of the flaps are cut back to form a chamfer whereby the distal axial length of each of the unstretched flaps is shorter than its proximal axial length.

15. A decorating tool suitable for use in providing a flowable suurface-coating having a broken pattern and applied to a surface, which tool comprises:

a roller, a plurality of flexible flaps, the flaps extending in a direction inclined at an angle of from 0° to 50° to the axis of the roller and each flap having a proximal end and a distal end, and means which attach the proximal end of each flap to the roller;

the extremities of the flaps being cut back to form a chamfer whereby the distal axial length of each of the unstretched flaps is shorter than its proximal axial length.

* * * * *